US006260481B1

(12) United States Patent
Winheim

(10) Patent No.: US 6,260,481 B1
(45) Date of Patent: Jul. 17, 2001

(54) APPARATUS FOR INCREASING THE GLOSS AND/OR SMOOTHNESS OF A WEB OF MATERIAL

(75) Inventor: Stefan H. Winheim, Frankfurt (DE)

(73) Assignee: V.I.B. Apparatebau GmbH (DE)

( * ) Notice: Subject to any disclaimer, the term of this patent is extended or adjusted under 35 U.S.C. 154(b) by 0 days.

(21) Appl. No.: 08/891,148

(22) Filed: Jul. 10, 1997

Related U.S. Application Data

(62) Division of application No. 08/735,194, filed on Oct. 21, 1996, which is a division of application No. 08/114,197, filed on Aug. 30, 1993, now abandoned.

(30) Foreign Application Priority Data

Jan. 16, 1993 (DE) ..... 43 01 023

(51) Int. Cl.[7] ..... D21G 1/00

(52) U.S. Cl. ..... 100/74; 34/629; 34/653; 100/99; 100/161; 162/206

(58) Field of Search ..... 100/38, 73–75, 100/92, 99, 161; 34/629, 653; 162/206, 207, 290

(56) References Cited

U.S. PATENT DOCUMENTS

| | | | | |
|---|---|---|---|---|
| 93,039 | * | 10/1869 | Seeley | 100/74 |
| 746,655 | * | 12/1903 | Andrus | 100/74 |
| 4,370,923 | * | 2/1983 | Schmidt | 100/74 |
| 4,642,164 | * | 2/1987 | Hanhikoski et al. | 100/74 |
| 4,786,529 | * | 11/1988 | Boissevain | 100/73 |
| 4,915,788 | * | 4/1990 | Wihheim | 162/207 |
| 4,945,654 | * | 8/1990 | Mason | 100/74 |
| 5,065,673 | * | 11/1991 | Taylor et al. | 100/74 |
| 5,122,232 | * | 6/1992 | Lyman et al. | 100/73 |
| 5,163,365 | * | 11/1992 | Taylor | 100/74 |
| 5,282,323 | * | 2/1994 | Winheim | 34/629 |

FOREIGN PATENT DOCUMENTS

| | | | | |
|---|---|---|---|---|
| 3741680 | * | 6/1989 | (DE) | 100/75 |

* cited by examiner

*Primary Examiner*—Stephen F. Gerrity
(74) *Attorney, Agent, or Firm*—Friedrich Kueffner

(57) ABSTRACT

A process and device for increasing the gloss and/or smoothness of a web of material are described, whereby a web of material (5) is passed through a roller gap where it is exposed to pressure. A steam dispensing device (7) is provided upstream of the roller gap relative to the direction of travel (9) of the web of material (5). The increase in gloss and/or smoothness is to be accomplished without consuming much energy. To do so, the steam is condensed on the web of material and the web of material (5) is guided through the roller gap before the increase in moisture content of the surface due to the steam treatment has dropped below a predetermined value. For this purpose, the steam dispensing device (7) has a steam blasting chamber (13) which is completely surrounded by a free housing wall (14) with a number of steam outlet openings (20) and other chamber walls (15–19) and it has a steam valve (21) for injecting steam into the steam blasting chamber (13), in which case at least one wall of the steam blasting chamber (13), preferably the free housing wall (14), is heated.

15 Claims, 4 Drawing Sheets

1'
2
3
4
5
6
7
7'
8
9
10
10'
11
12

APPARATUS FOR INCREASING THE GLOSS AND/OR SMOOTHNESS OF A WEB OF MATERIAL

This is a Division of application Ser. No. 08/735,194 filed Oct. 21, 1996 (pending) which is a continuation of Ser. No. 08/114,197 filed Aug. 30, 1993, abandoned.

FIELD OF THE INVENTION

This invention concerns a process for increasing the gloss and/or smoothness of a web of material, especially a web of paper, whereby a web of material that is moistened with the help of steam is guided through a roller gap where it is exposed to a pressure, and this invention also concerns a device for increasing the gloss and/or smoothness of a web of material with a pair of rollers that form a roller gap and a steam dispensing device arranged upstream from the roller gap in the direction of travel of the web.

BACKGROUND OF THE INVENTION

Gloss and smoothness are characteristics of a web of material that affect not only the appearance of the material but also its processability. For certain applications, high gloss and/or smoothness values are desired but they should also be as uniformly reproducible as possible.

At first the pressure in the roller gap was increased in order to increase the gloss and/or smoothness. However, this has the negative effect that the web of material is greatly compressed on the whole and thus suffers a loss of volume. In addition the web of material may also lose stability in this way. To prevent this disadvantage from becoming too serious, there was subsequently a trend toward increasing the temperature of the rollers that form the roller gap. This made it possible to further increase the gloss and smoothness but such a procedure is very energy intensive. In order to achieve roller temperatures of 200° C., substantial quantities of energy must be supplied continuously because the rollers are constantly being cooled by the web of material passing by. In addition there have also been attempts to influence the gloss and smoothness through the moisture content of the web of material, but this has the disadvantage that the moisture supplied to the web must be removed again at least in part after the treatment, which entails additional process steps that increase the amount of time and equipment required for treatment of the web of material. Steam blasting tubes arranged between two roller gaps downstream from the deflection in a web of paper are known for influencing the moisture content when processing paper on supercalenders (U.S. Pat. No. 5,122,232). The steam emitted from the steam blasting tubes condenses in the ambient air and is deposited as a mist—for example, in the form of extremely fine water droplets—on the web of material. Another disadvantage of this procedure is that the entire vicinity around the web of material is then exposed to a very humid atmosphere that leads to corrosion of metal parts in the smoothing device.

This invention is therefore based on the problem of simplifying the method of improving the gloss and/or smoothness.

SUMMARY OF THE INVENTION

This problem is solved in a process of the type defined initially by the fact that the steam condenses on the web of material which is guided through the roller gap before the increase in moisture content of the surface due to the steam treatment has dropped below a predetermined level.

In this way it is possible to achieve not only a moistening of the web of material but at the same time an increase in temperature is achieved. The heat contained in the steam is transferred to the web of material in condensation, so this measure results in a web of material having the required temperature at the surface and also having the required moisture content. When this web of material is guided through the roller gap, the roller gap then affects essentially only the surface of the web of material without causing changes deep in the web of material, i.e., in the direction of the thickness, to any mentionable extent. Therefore, the volume of the web of material is largely maintained although the surface quality is definitely improved. The rollers need not be heated nearly as much. Furthermore, the pressure in the roller gap can be kept lower than in the past. This saves a considerable amount of energy. It is possible to determine empirically or by calculations how long it takes for the moisture to penetrate into the interior of the web. However, before this condition occurs, the web—or more precisely, its surface—has already been treated in the roller gap. Thus the steam treatment takes place immediately before the web of material enters the roller gap. This yields two advantages. First, the surface of the web is still at a relatively high temperature and has a relatively high moisture content, so the increase in gloss and/or smoothness is accomplished even at a low pressure and low temperature in the roller gap. Secondly, the web does not absorb any mentionable amount of moisture, so no expensive aftertreatments are necessary. The energy needed to treat the surface is kept in the same range where the treatment takes place, i.e., where the smoothing is to occur. The rest of the web is not affected at all or is impaired only to a slight extent.

Preferably the predetermined value for the moisture content is in the range of 12% to 25%, especially in the range of 16% to 25%. Thus a relatively large amount of moisture is supplied to the surface. However, since this supply of moisture is limited to the surface and a thin layer beneath the surface, this treatment does not result in any mentionable loss of volume nor any great increase in the moisture content of the web in general.

It is especially preferable here that the web of material is guided into the roller gap before the temperature in the middle third of the thickness of the web has reached 1/e times the surface temperature. (Note that "e" is the base of natural logarithms and is approximately equal to 2.7182818285). This permits an adequate distance between the steam treatment of the web and the roller gap which cannot be reduced to zero for structural reasons. On the other hand, the difference between the middle third of the web and the outer third of the web with regard to the temperature is so great that the smoothing treatment is limited to the outer third if the temperature has an influence there. The influence of the moisture content is limited to even thinner areas of the surface because the temperature penetrates faster than the moisture.

It is advantageous for the steam to be kept free of water droplets until it strikes the web of material. Thus, on the one hand, means are taken to assure that the steam does not contain any water droplets, but on the other hand, water droplets are not allowed to form in the steam. This can be accomplished, for example, by heating the steam until just before it strikes the web of material. In this way it is possible to assure that all the heat contained in the steam can be transferred to the surface of the web of material in condensation in order to bring about the desired increase in temperature which is associated with an increase in the moisture content at the surface. Before the steam strikes the web, no cloud of mist is formed, so there is not such a great increase in the atmospheric humidity in the vicinity of the machinery.

It is advantageous for the steam to first be distributed in a distribution chamber over an outlet area having a predetermined expansion in the direction of travel of the web of material and then for the steam to move at a high velocity within a predetermined range in the direction of the web of material. The amount of steam that condenses on the web of material can be controlled on the basis of this velocity. This velocity also depends on the velocity of the web of material and is generally 15 m/s or more. Due to the fact that the steam is first distributed in a distribution chamber, this yields the advantage that the treatment of the web of material is relatively uniform over the width of the web. The flow rate of the steam can be controlled on the basis of the pressure in the distribution chamber.

It is also advantageous to determine the gloss and/or smoothness and/or a corresponding parameter of the web of material downstream from the roller gap and to adjust the amount of steam dispensed as a function of the difference between the actual value thus determined and a given set point. Thus the production of gloss and/or smoothness takes place in a closed control circuit where the amount of steam dispensed is used as a control parameter. Optionally additional heating of one or both of the rollers that form the roller gap may also be included.

Preferably the steam treatment takes place in several zones in the transverse direction of the web, such that the amount of steam dispensed can be adjusted separately in each zone. The transverse direction is the direction in the plane of the surface of the web of material which is perpendicular to the direction of travel of the web of material. Being able to adjust the steam by zones makes it possible to equalize any differences in gloss and smoothness not only in the longitudinal direction of the web of material, i.e., the direction of travel, but also in the transverse direction of the web, should this be necessary. Equalization of the smoothness in the longitudinal direction is then accomplished, for example, by controlling the total amount of steam released. The control in the transverse direction is accomplished by adjusting the amount of steam dispensed by zones.

The supply of steam is preferably limited essentially to the amount per unit of time that can condense on the web of material. The steam supplied is thus essentially completely consumed so that practically no steam can escape and lead to an increase in the humidity of the ambient atmosphere.

For a precision adjustment of the gloss and/or smoothness, it is also advantageous to adjust the temperature of at least one of the rollers forming the roller gap. The desired gloss and/or smoothness values can be achieved with a high accuracy through the combination of steam treatment which is also associated with an increase in temperature of the web and controlling the temperature of the rollers.

It is especially preferable here for the roller to be heated at the surface. If the heating of the roller is limited to its surface, relatively rapid reaction times can be achieved. Furthermore, the energy consumption is minimized.

The temperature adjustment is preferably accomplished with a control circuit that is subordinate to a control circuit that controls the amount of steam released. Thus the temperature control circuit is subject to the steam release control circuit. In any case the steam release control circuit has a higher priority so the approximate settings can be performed much more rapidly than the fine settings.

This problem is solved with a device of the type defined initially due to the fact that the steam releasing equipment has a steam blasting chamber that is completely surrounded by a free housing wall with a number of steam outlet openings and other chamber walls and it also has a steam valve for injecting steam into the steam blasting chamber, in which case at least one wall of the steam blasting chamber, especially the free housing wall, is heated.

Such a steam blasting chamber is essentially known from unpublished German Patent Application P 41 25 062. Use of such steam dispensing equipment in conjunction with increasing the gloss and smoothness of a web of material has the advantage that in this way it is possible to apply steam that is practically free of water droplets to the web of material. Any condensation of the steam in the steam blasting chamber is prevented because the steam blasting chamber is heated. Thus a condition in which the steam can be only in the gaseous state is maintained in the interior of the steam blasting chamber. Heating the steam blasting chamber also has the advantage that it facilitates starting up operation of the machinery again after an interruption in operation such as that which can occur when changing rollers. Even when there is an interruption in operation, the steam blasting chamber does not cool off, so there is practically no danger of steam condensing in the steam blasting chamber where it can lead to formation of water droplets in resuming operation. This assures that steam that is free of water droplets at all times is directed at the web of material where it can condense.

Preferably the free housing wall and the web of material enclose a steaming space which is largely sealed at the sides by the housing parts of the steam dispensing equipment. This assures on the one hand that the steam released from the steam dispensing equipment cannot escape freely into the environment but instead remains in the steaming space where it can be absorbed by the web of material. On the other hand, the steaming room is also heated, especially when the free housing wall is heated, so the steam is kept at the required temperature until the end. The steam can thus result in the required increase in temperature of the surface of the web of material when it condenses on the web of material.

Preferably a heating device operated with steam is provided for heating purposes, in which case the steam valve and the heating equipment are connected to the same steam supply connection. Thus the heating equipment operates at a temperature that corresponds essentially to the steam temperature. Thus the steam blasting chamber and also the steaming room are kept at a temperature that corresponds to the temperature of the steam to be supplied to the web of material. This yields an adjusted heating effect with relatively simple means. The steam to be dispensed always encounters an environment that corresponds essentially to its own temperature. This avoids any possible negative phenomena that could occur as a result of sudden changes in temperature to which the steam would be exposed.

Preferably the heating equipment and the steam valve are arranged in a row. Thus the steam first heats the steam blasting chamber with the help of the heating equipment before it enters the steam blasting chamber heated by the steam itself. The heating equipment is thus always at a slightly higher temperature than the steam entering the steam blasting chamber. It is thus capable of transferring energy to the steam again in order to reliably prevent water droplets from developing in the steam blasting chamber. In addition, this measure also makes it possible to lower the temperature of the, steam to the extent that the steam can condense on the web of material to the desired extent. If the steam is too hot, this also yields a transfer of heat from the steam to the surface of the web of material. However, the transfer of heat is much better if the steam can condense on the surface of the web of material. In this case the desired moisture content at the surface is also established at the same time.

It is especially preferable here for the heating equipment to have a steam drying section. Any droplets of water that might be able to form in the transport of the steam from the steam generating device to the steam dispensing device can be removed reliably in the steam drying section. Thus only dry steam is supplied to the steam valve, so the danger of damaging the web of material passing by as a result of water droplets striking it is not only reliably prevented but is practically completely ruled out.

Preferably a front wall of the steam dispensing device next to a roller is inclined with respect to the free housing wall. The entire steam dispensing device is thus designed in a wedge shape at least in this area. Thus the steam dispensing device can be brought very close to the roller gap, so the steam treatment takes place directly in front of the roller gap. Then when the web of material passes through the roller gap, neither the temperature nor the moisture has practically any opportunity to spread in the interior of the web of material. Thus since only the surface or a thin layer beneath the surface have an elevated temperature and an elevated moisture content, only this area of the web is treated in the roller gap (i.e., smoothed or provided with a greater gloss).

Preferably the angle of slope is between 35° and 55°. This angle range permits the steam dispensing device to dispense the steam up to a very small distance away from the roller gap. On the other hand, however, it permits an adequate structural height so the steam blasting chamber can be designed with an adequate height for distribution of the steam.

Preferably the steam blasting chamber is subdivided into zones across the direction of travel of the web of material such that each zone has steam valves that can be controlled separately. The amount of steam applied to the web of material can thus be controlled at least by sections across the direction of travel of the web of material. It is thus also possible to influence the gloss and/or smoothness at least by zones across the web of material. This also makes it possible to achieve a greater uniformity in the direction across the web of material.

Preferably a gloss or smoothness measurement device is provided here downstream from the roller gap in the direction of travel of the web of material. This measurement device is connected to a control device which in turn controls the steam valves as a function of the gloss or smoothness set point. The steam treatment thus takes place in a closed control circuit. If the measured gloss or smoothness values drop below a given set point, the steam valve in the corresponding zone is actuated in order to bring the values back to the set range. If the actual value increases beyond the set point, the steam valve is influenced in the other direction.

The steam valves preferably have outlet openings arranged at an angle to the free housing wall so that no steam jet is aimed directly at the free housing wall. This yields a relatively uniform distribution of steam passing through the free housing wall. A partial increase in steam velocity which would result if a steam jet were to leave the valve directly through an outlet opening is thus reliably prevented.

Preferably the jet of steam leaving the steam valves is directed at a chamber wall at an angle not equal to 90°. This prevents a steam jet from being reflected back into itself would could lead to turbulence which could interfere with a uniform distribution of steam from the outlet openings.

Preferably U-shaped sections whose openings are covered by the free housing wall and form channels as part of the heating equipment are mounted on the free housing wall in the steaming room between the steam outlet openings. These channels thus run in the steaming room, so they heat not only the free housing wall and the steam blasting chamber but also the steaming room so that ultimately an environment where the steam will retain its gaseous form is maintained. Condensation of the steam thus actually takes place only directly on the web of material.

The steam preferably has a temperature in the range of 102° C. to 110° C. Such a steam temperature assures that the steam can condense completely on the web of material where it will cause the desired increase in temperature and moisture of the surface.

The distance from the steam dispensing device to the roller gap can preferably be varied. This measure makes it possible to control how deep the temperature and moisture can penetrate into the web of material before the web of material enters the roller gap. In this way it is also possible to accomplish a change in the gloss and smoothness which may then optionally be included in the control circuit.

One steam dispensing device is preferably arranged on each side of the web of material upstream from the roller gap. The web of material here is treated with steam simultaneously from both sides. This is advantageous, especially in the case of simple smoothing equipment where there is only a single roller gap.

BREIF DESCRIPTION OF THE DRAWINGS

This invention will be described in greater detail below with reference to a preferred embodiment as illustrated in the figures which show the following:

DESCRIPTION OF THE PREFERRED EMBODIMENT

Figure 1:
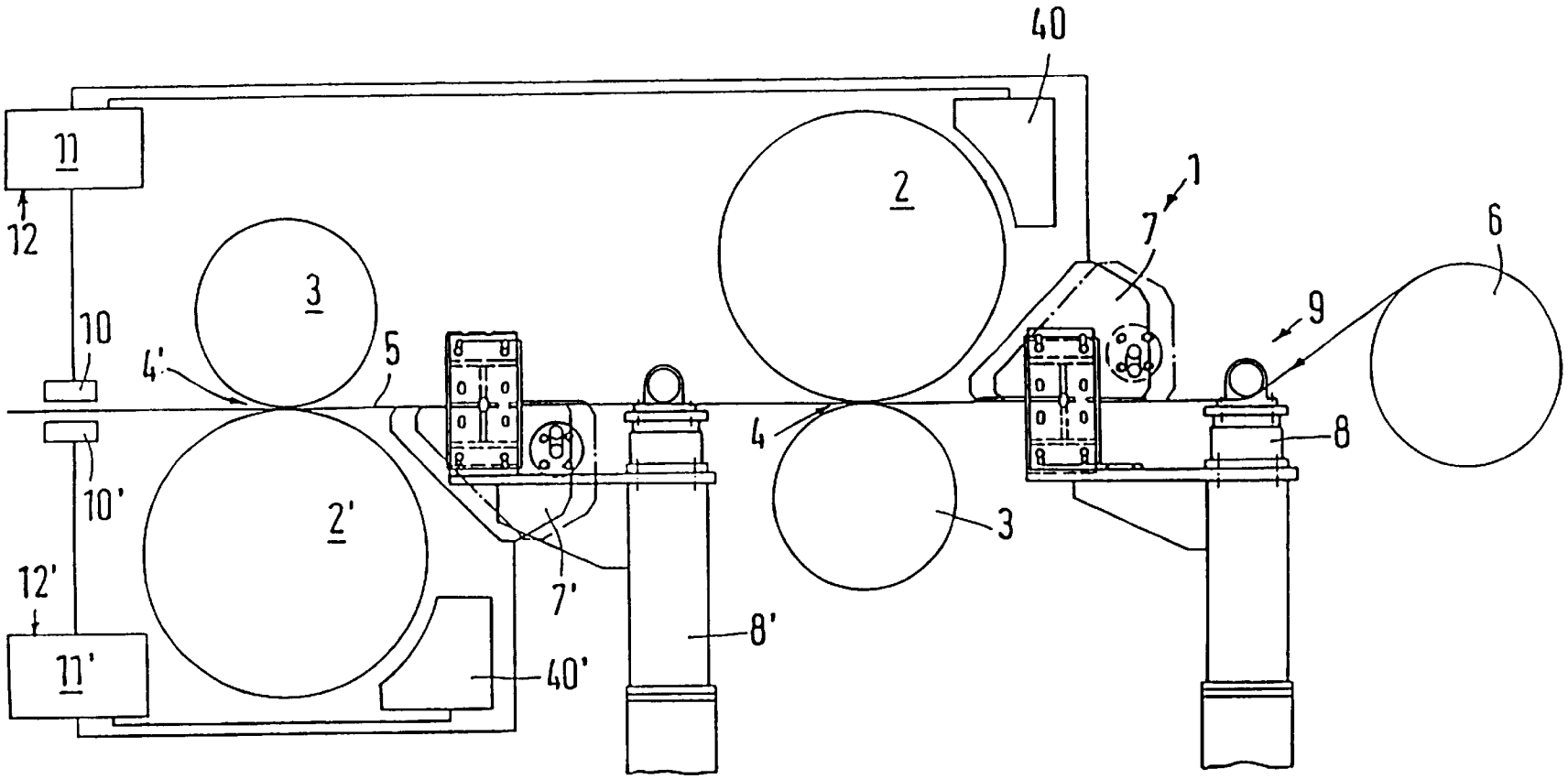
FIG. 1 shows a schematic view of a device.

A device 1 for increasing the gloss and/or smoothness of a web of material has two rollers 2, 3 which form a roller gap 4 between them through which the web of material 5 is guided. In this device 1, one side of the web of material 5, namely the top side here, is smoothed and/or provided with a gloss. A corresponding device 1' is provided for the bottom side of web of material 5. The corresponding parts have the same reference numbers but are shown with dotted lines to distinguish them. Device 1' for the bottom side of the web of material 5 is discussed only when it differs from device 1. Of the two rollers, one can be designed as a soft roller. Rollers 2, 3 may form a so-called machine calender. One or both rollers 2, 3 may be heated by heating device 40. The heating may also take place from the interior. For the purpose of illustration, a web of paper is regarded as the web of material in the following discussion. However, other materials that consist of or contain cellulose may also be used. The web of paper is unwound from a supply roller 6 and then after passing through device 1 it is wound onto a receiving roller that is not defined in greater detail. However, paper web 5 may also be removed directly from a paper machine.

Upstream from roller gap 4, there is a steam dispensing device 7 that can move on a stand 8. It can be brought closer to the roller gap 4 or away from it, either with or against the direction of travel 9 of the web of paper. The steam dispensing device which is described in greater detail in conjunction with FIGS. 2 to 4 dispenses steam in the direction of the web of material where it condenses.

A measurement device 10 for determining the actual gloss or smoothness is provided downstream from roller gap 4 in the direction of travel 9 of the web of paper. This measurement device 10 may extend over the entire width of paper web 5 but it is equally possible for this measurement device to move across the web of paper 5 during its travel, in which case the gloss and/or smoothness are determined continuously over the entire web of paper, although not simultaneously. The measurement device 10 is preferably mounted downstream from roller gap 4' for the second side of the web of material.

Measurement device 10 is connected to a controller 11 which in turn controls the steam dispensing device 7 as a function of a difference between the measured values determined by measurement device 10 and other set point values supplied through a set point input 12. Controller 11 may also control the heating device 40. Separate controllers 11, 11' are provided for the top side and bottom side. It is obvious that these controllers can also be combined.

The steam dispensing device 7 for the top side of the web of paper 5 is arranged above the web of paper 5 and the steam dispensing device 7' for the bottom side of the web of paper is arranged below the web of paper 5, so the web of paper 5 is treated with steam from both sides in a manner that is staggered with regard to both time and space. In any case a roller gap 4, 4' follows each steam dispensing device 7, 7'. If only one side of paper web 5 is to be treated, then only one steam dispensing device 7 or 7' will be provided. Therefore, only one steam dispensing device 7 is described in greater detail below. The other steam dispensing device 7' corresponds to it in mirror image.

Steam dispensing device 7 has a steam blasting chamber 13 that is bordered by a free housing wall 14 and other housing walls 15, 16, 17, 18 and 19. Free housing wall 14 has steam outlet openings 20 that have a diameter smaller than the thickness of the free housing wall. These openings 20 are therefore shown only as a dash. Each steam blasting chamber also has a steam valve 21. The steam valve allows steam which it receives through supply channel 22 to enter steam blasting chamber 13. Valve openings 23 here are directed in such a way that none of the steam jets 24 coming from the steam valve strike the free housing wall 14 directly nor are they are directed at an angle of 90° at any other housing wall. This prevents steam jets 24 leaving steam valve 21 from passing directly through openings 20 in free housing wall 14. On the other hand this also prevents the steam jets from being reflected on the other housing walls, which could lead to unwanted turbulence of the steam in the steam blasting chamber 13.

Free housing wall 14 together with paper web 5 and other housing parts 25, 26, 27 and 28 enclose a steaming room 29. Of course a small gap is provided between paper web 5 and the remaining housing parts 25 to 28. Paper web 5 should not rub on the housing parts.

Essentially U-shaped plates 30 whose openings are covered by free housing wall 14 are mounted on the free housing wall 14 in the steaming room 29. These plates 30 together with the free housing wall 14 form heating channels 31. When steam is sent through the heating channels 31, the free housing wall 14 and thus the steam blasting chamber 13 are heated. In addition, the steaming room 29 is also heated. The outlet openings, 20 in the free housing are arranged between plates 30.

Not only the free housing wall 14 is heated but also housing wall 15 is heated by the supply channel 22 which also contains hot steam. Housing wall 17 is heated by steam channel 32. This steam channel is designed as a steam drying section. It is connected to a steam connection 33 by means of which steam is supplied from a steam generator that is not shown here. On both sides of the steam dispensing device there are side channels 34, 35 so the steam dispensing device 7 is also heated at both sides. One side channel 35 has a throttle 36 at its end, in other words, just before the opening into the supply channel 22. This throttle results in a difference in pressure between the left side channel 34 and the right side channel 35.

Steam supplied through steam connection 33 flows first through steam channel 32 (as indicated by arrows) where it is dried—in other words, any droplets of water still in the steam are precipitated here and can be removed through a condensate line 37. Then the steam flows through the right side channel 35, and on the basis of the pressure difference created by throttle 36 between the left side channel 34 and the right side channel 35, the steam also flows through channels 31 to the left side channel 34. Another part of the steam flows into the supply channel 32 from which it reaches the steam valves 21. Thus the steam blasting chamber 13 is not heated from all sides but is heated from many sides. Thus a temperature in which the steam cannot condense out is maintained easily in the steam blasting chamber 15 even after an interruption in operation.

Excess steam can be removed through outlet 38.

Figure 3:
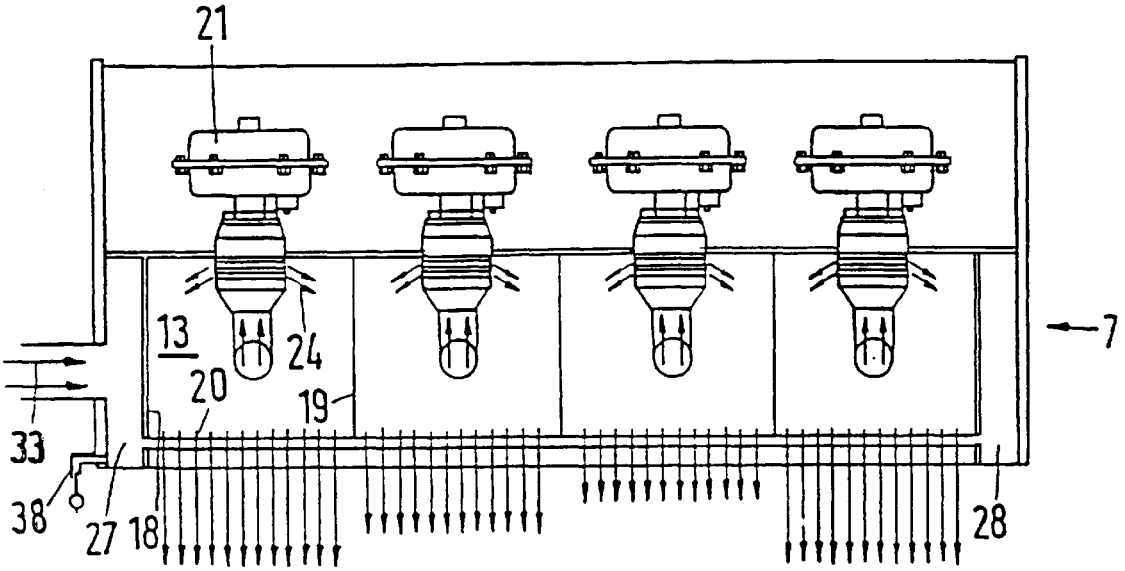
FIG. 3 shows a front view of a steam dispensing device.
Figure 4:
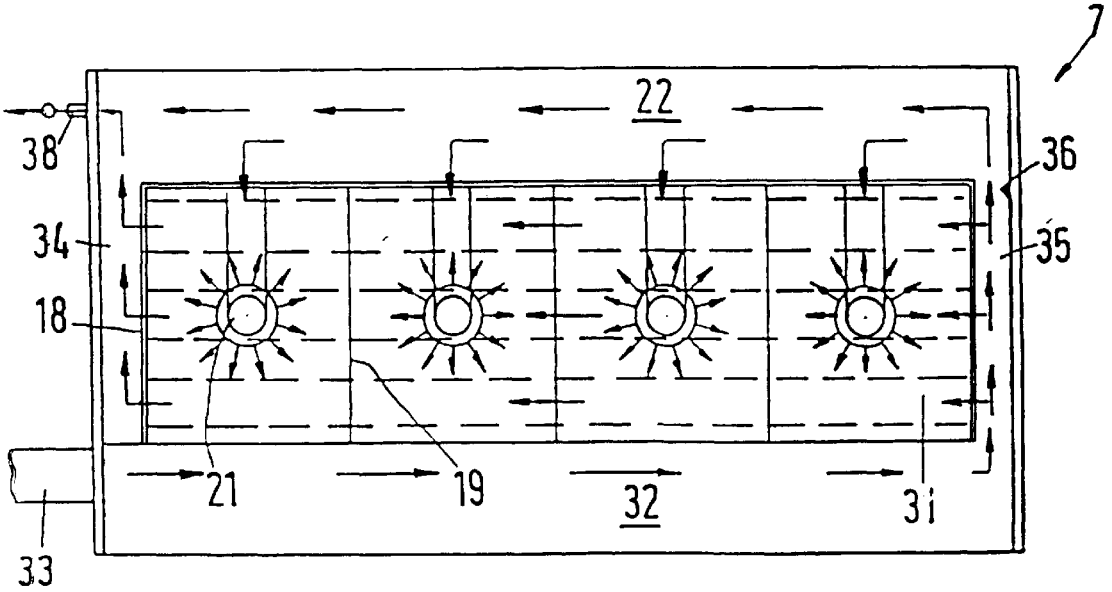
FIG. 4 shows a top view of the steam dispensing device.

As shown especially in FIGS. 3 and 4, several (namely four in the example shown here) steam blasting chambers 13 are provided across the width of paper web 5. Each steam blasting chamber 13 has its own steam valve 21. Each steam valve 21 can be controlled separately by controller 11. The gloss and/or smoothness can thus be adjusted separately in four ranges across the direction of travel 9 of the web of paper.

Figure 2:
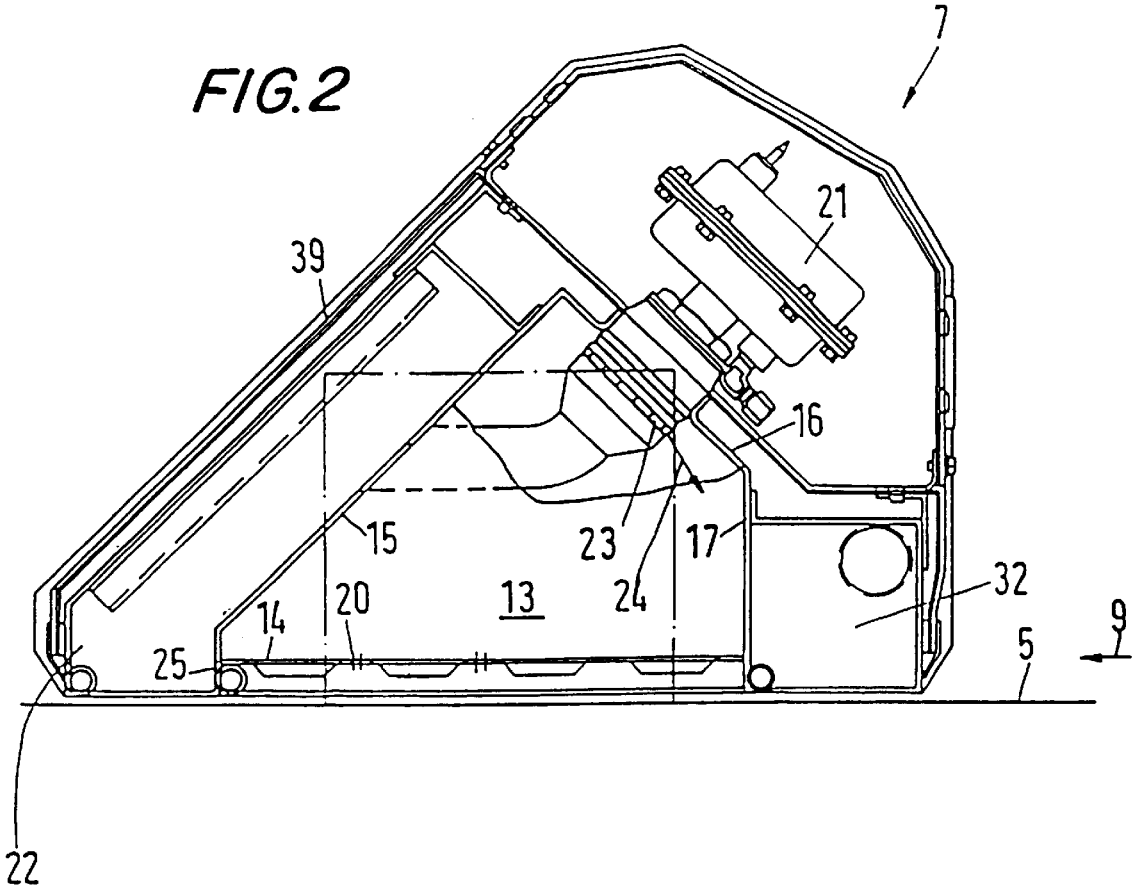
FIG. 2 shows an enlarged detail from FIG. 1, partially in sectional view.

As shown in FIGS. 1 and 2, the steam dispensing device 7 has the form of a wedge in cross section. In other words, wall 15 and its corresponding outside wall 39 are inclined with respect to free housing wall 14. It forms an angle in the range between 35°and 55°, namely about 45° in the present case. This makes it possible for the steam dispensing device 7, or more precisely the steaming room 29, to be placed relatively close to roller gap 4. In this way the steam can be applied to paper web 5 relatively late before reaching the roller gap, so the steam will condense there but the increase in temperature and moisture in paper web 5 due to condensation cannot penetrate into the interior of the web of paper and lead to an equalization of this effect when the paper web 5 is exposed to the pressure in roller gap 4.

OPERATION

Figure 5:
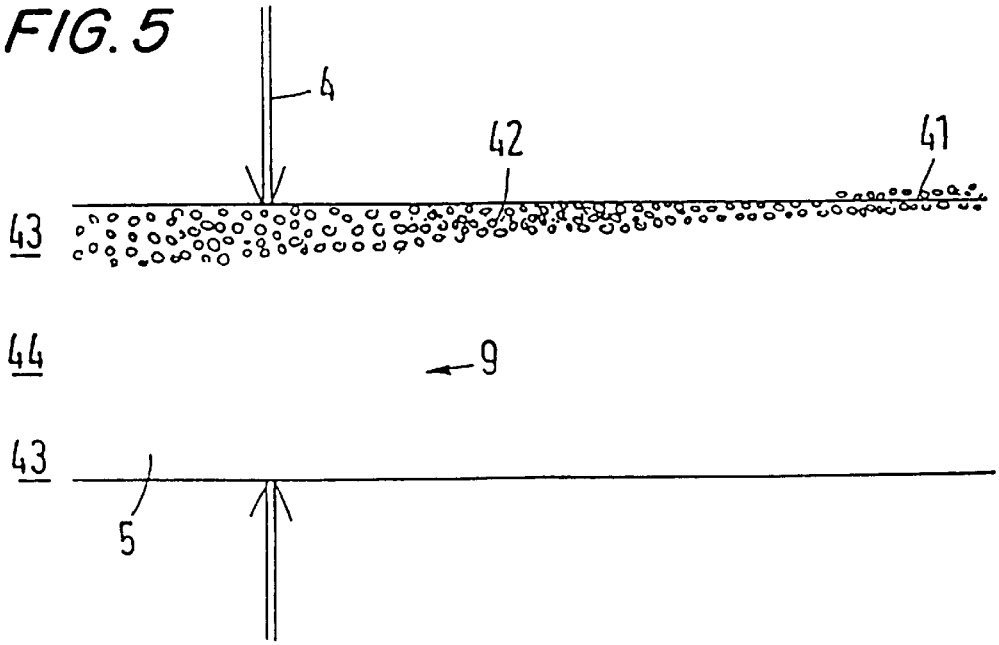
FIG. 5 shows a schematic cross section through a web of material.

Operation of this device is as follows: The steam dispensing device 7 is placed as close as possible to roller gap 4, where the distance can be adjusted as a function of the velocity at which the paper web 5 passes through roller gap 4. The steam dispensing device 7 is then heated with the help of steam. When it is so hot that the temperature prevailing in steam blasting chamber 13 is sufficient to preclude condensation of the steam, i.e., a temperature approximately in the range of 102° C. to 110 C., operation can begin. Paper web 5 is then moved through the roller gap. At the same time the steam dispensing device 7 receives steam through steam connection 33. Steam valves 21 open and allow steam to enter the steam blasting chamber 13 where it spreads and flows through openings 20 at a relatively uniform pressure and especially a uniform high velocity of 15 m/s or more through openings 20 into the steaming room 29, where it comes in contact with paper web 5. As soon as the steam comes in contact with the relatively cold web of paper 5, it condenses, in which case it drastically increases the temperature at the surface of paper web 5. This condition is shown on the right side of FIG. 5. With a cold web of paper 5 at a temperature of about 30° C., the surface will be about 90° C. after condensation of the steam. At the same time, a film of moisture 41 whose thickness is preferably in the range of a thousandth of a millimeter is formed by the condensed steam. Condensation yields an almost sudden increase in temperature in the surface of paper web 5 but it is equalized over the thickness of paper web 5 within a very short period of time. In other words, the web of paper has a uniform temperature distribution within a few hundredths of a second. Equalization of the moisture content takes somewhat longer. Moisture 42 penetrates more slowly than the temperature into paper web 5. Therefore, a surface area 43 of paper web 5 will have a much higher relative moisture content. The farther the moisture content penetrates into the interior of 44 of paper web 5, the more there will be a decrease in relative moisture content. However, before it has dropped below a predetermined value in the range of 12% to 25%, especially 16% to 25%, the treatment takes place in roller gap 4 where the web is treated at a relatively low pressure and low temperature in relation to the known technical implementations, namely the surface of the web which still has an elevated temperature and moisture content is smoothed or provided with an increased gloss. The areas 44 of paper web 5 farther in the interior do not undergo any mentionable change as a result of the treatment in the roller gap.

If controller 11 finds that the gloss and smoothness values measured by the measurement device 10 do not correspond to the set points 12, it will activate the steam valves 21 until the difference between the actual values and the set point has dropped below a predetermined amount. This can be accomplished by zones so that different gloss and smoothness values can be equalized across the width of paper web 5. At the same time, controller 11 can control the temperature of the roller surface with the help of heating device 40 in a control circuit having a lower priority in order to achieve a precision adjustment of the gloss and/or smoothness values.

For an approximate adjustment, the distance between the steam dispensing device 7 and roller gap 4 can be adjusted as shown by the dash-dot lines in FIG. 1. This adjustment is usually performed manually but controller 11 may also perform this approximate adjustment.

Figure 6:
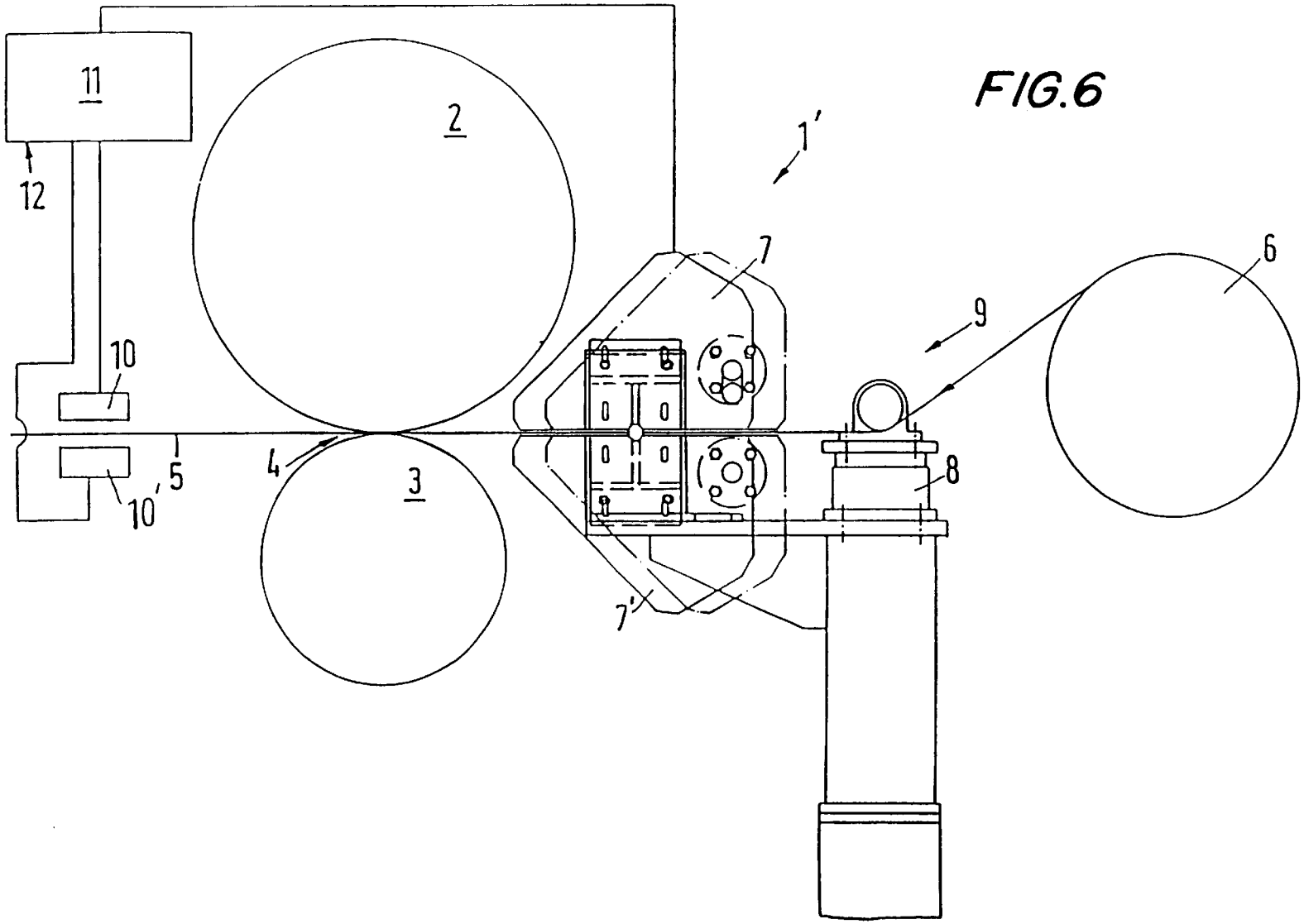
FIG. 6 shows a schematic view of a second embodiment of this invention.

FIG. 6 shows a second embodiment of a device 1' which has only a roller gap 4. Rollers 2 and 3 form a simple smoothing calender. The design of rollers 2 and 3 as hard or soft rollers is determined by the given factors in each case. In this design, a steam dispensing device 7 or 7' is provided on both sides of the web of paper upstream from the roller gap. The steam treatment thus is applied simultaneously to both sides of the web of paper 5. The gloss and/or smoothness values are measured on both sides of paper web 5 by the two measurement devices 10 and 10' and the values are sent onto controller 11 which then controls the two steam dispensing devices 7, 7'.

In this embodiment the surfaces of rollers 2 and 3 were not heated. However, this can be provided as shown in FIG. 1.

In the present embodiment, a paper web 5 was used. However, this process and device are also suitable for other types of webs of material containing cellulose fibers such as cardboard or paperboard.

With the device according to this invention it is possible to control the gloss and/or smoothness of a web of material in the direction of travel in the machinery, in other words, in the direction of travel of web of material 5, and also to control these values in the transverse direction. Control in the longitudinal direction can be accomplished by controlling the amount of steam supplied to the steam dispensing devices 7, 7'. Control in the transverse direction is accomplished by controlling the amount of steam dispensed zone by zone, i.e., by adjusting the ratio of the amounts of steam dispensed in the individual zones.

While the particular method and apparatus for increasing the gloss and/or smoothness of a web of material as herein shown and disclosed in detail is fully capable of obtaining the objects and providing the advantages herein before stated, it is to be understood that it is are merely illustrative of the presently preferred embodiments of the invention and that no limitations are intended to the details of construction or design herein shown other than as described in the appended claims.

What is claimed is:

1. A device for increasing the gloss and/or smoothness of a web of material having a direction of travel, said device comprising:

a pair of rollers that form a roller gap; and a steam dispensing device for dispensing steam, said dispensing device being located upstream from the roller gap relative to the direction of travel of the web, wherein the steam dispensing device (7) has a steam blasting chamber (13) which is completely surrounded by a free housing wall (14) having a number of steam outlet passages (20) and other chamber walls (15–19), said steam dispensing device (7) further comprises a steam valve (21) for injecting steam into the steam blasting chamber (13), said steam blasting chamber (13) having at least one wall (14, 15, or 17) which is heated.

2. The device as recited in claim 1 wherein the free housing wall (14) and the web of material (5) enclose a steaming room (29) which is largely sealed at the sides by housing parts (25–28) of said steam dispensing device (7).

3. The device as recited in claim 2 wherein U-shaped sections (30), whose openings are covered by the free housing wall (14) and form channels (31) as part of the heating system, are mounted on the free housing wall (14) in the steaming room (29) between the steam outlet openings (20).

4. The device as recited in claim 1 wherein a steam operated heating device (22, 31, 32) is provided for heating whereby the steam valve (21) and heating device are connected to a steam supply connection (33).

5. The device as recited in claim 4 wherein the heating device (22, 31, 32) and the steam valve (21) are arranged in a row.

6. The device as recited in claim 5 wherein the heating device (22, 31, 32) has a steam drying section (32).

7. The device as recited in claim 1 wherein a front wall (39) next to a roller (2) in said steam dispensing device (7) is inclined at an angle of slope with respect to the free housing wall (14).

8. The device as recited in claim 7 wherein the angle of slope is between 35° and 55°.

9. The device as recited claim 1 wherein the steam blasting chamber (13) is subdivided into zones across the direction of travel (9) of the web of material (5) and these zones have steam valves (21) that can be controlled independently of each other.

10. The device as recited in claim 9 wherein a gloss or smoothness measurement device (10) is provided downstream from the roller gap (4) in the direction of travel (9) of the web of material (5), said measurement device (10) being connected to a control device (11) which controls the steam valves (21) as a function of gloss or smoothness set point values.

11. The device as recited in claim 1 wherein the steam valve (21) has outlet openings (23) that are arranged at an angle to the free housing wall (14) such that no steam jet (24) is aimed directly at the free housing wall (14).

12. The device as recited in claim 11 wherein each steam jet (24) leaving the steam valve (21) is directed at a chamber wall (15–19) at an angle not equal to 90°.

13. The device as recited in claim 1 wherein the steam has a temperature in the range of 102° C. to 110° C.

14. The device as recited in claim 1 wherein the distance between the steam dispensing device (7) and the roller gap (4) is variable.

15. The device as recited in claim 1 wherein a steam dispensing device (7, 7') is provided on each side of the web of material (5) upstream from the roller gap (4).

* * * * *